US007219405B1

(12) United States Patent
Nevens

(10) Patent No.: US 7,219,405 B1
(45) Date of Patent: May 22, 2007

(54) FABRIC ATTACHING CLIP

(76) Inventor: Susan E. Nevens, 4000 E. Airport Dr., Ontario, CA (US) 91761

( * ) Notice: Subject to any disclaimer, the term of this patent is extended or adjusted under 35 U.S.C. 154(b) by 57 days.

(21) Appl. No.: 11/177,950

(22) Filed: Jul. 11, 2005

(51) Int. Cl.
*A44B 21/00* (2006.01)
*A44B 17/00* (2006.01)
*A44B 11/25* (2006.01)

(52) U.S. Cl. ..... 24/464; 24/306

(58) Field of Classification Search ..... 24/72.5, 24/306, 464; 5/504.1, 498
See application file for complete search history.

(56) References Cited

U.S. PATENT DOCUMENTS 1,417,244 A * 5/1922 Hammerberg ..... 24/335
1,602,305 A * 10/1926 Helm ..... 24/72.5
1,858,787 A * 5/1932 Ottenheimer ..... 24/72.5
2,745,163 A * 5/1956 Buren, Jr. ..... 24/464
3,052,006 A * 9/1962 Jonas ..... 24/478
4,829,617 A * 5/1989 Dameron ..... 24/306

* cited by examiner

*Primary Examiner*—Robert J. Sandy
(74) *Attorney, Agent, or Firm*—Albert O. Cota

(57) ABSTRACT

A fabric attaching clip (10) consisting of a garter grip button end (20) attached to a loop tape strap (24) positioned on an outer surface of a fabric (26). A garter grip wireform (22) is attached to a hook and loop tape strap (30) that is positioned on an inner surface of the fabric, aligning with the garter grip button end (20) and tightly engaged with the fabric drawn compressably between. The fabric attaching clip (10) permits fabric, to be swagged by gathering the fabric with the loop tape strap, which has the end threaded into the wireform and by pulling the extending end for adjustment. The loop tape strap (24) is joined to the hook and loop tape strap (30) for closure therebetween. A theme decoration (38) having a hook tape segment (40) is attached on a front surface of the loop tape strap (30), providing both a decorative effect to a table and covering the clip (10).

14 Claims, 5 Drawing Sheets

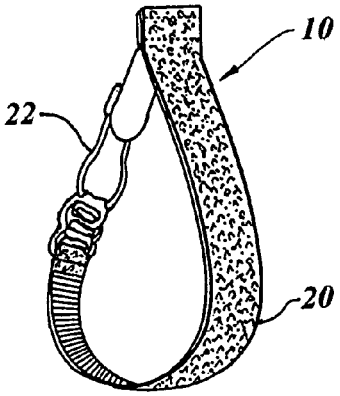
FIG. 20
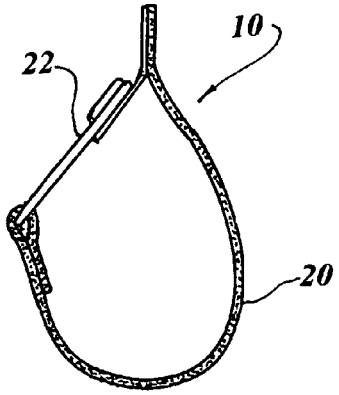
FIG. 21
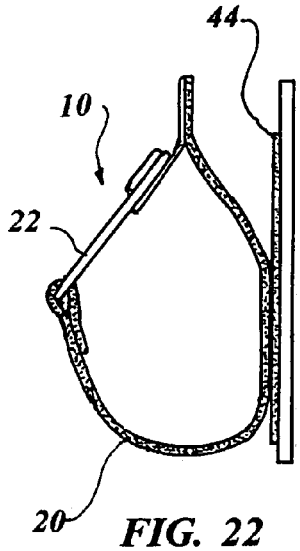
FIG. 22
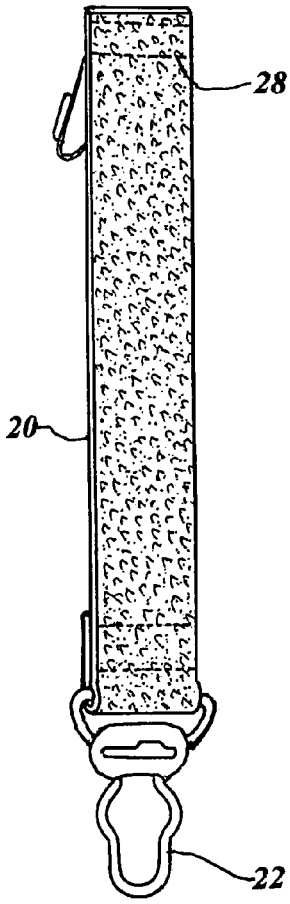
FIG. 23
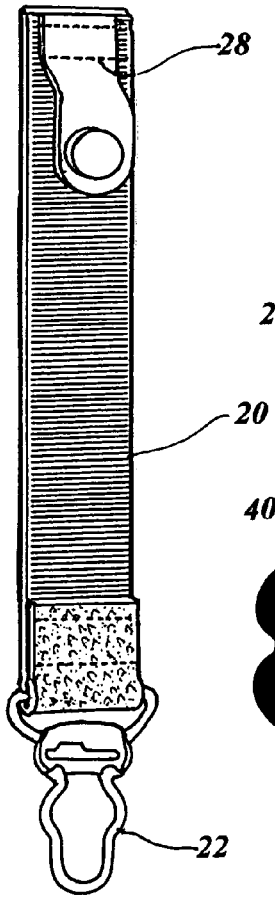
FIG. 24
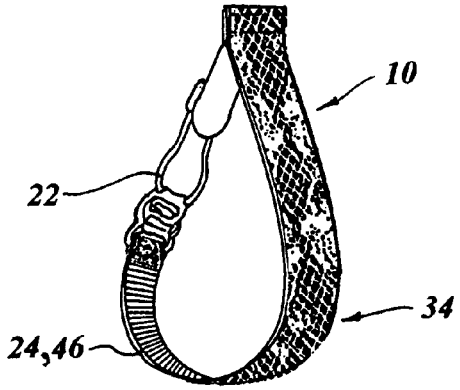
FIG. 25
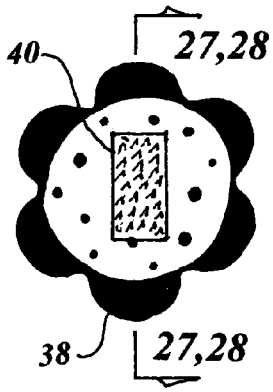
FIG. 26
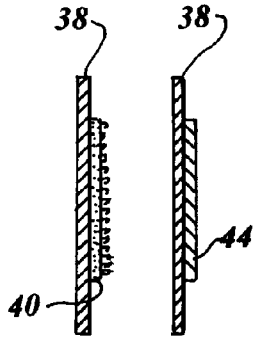
FIG. 27
FIG. 28

FABRIC ATTACHING CLIP

TECHNICAL FIELD

The invention generally pertains to clips for fabric attachment, and more specifically to a clip for swagging tablecloths or mounting an ornamental decoration on any fabric.

BACKGROUND ART

Previously, many types of clips have been used to provide an effective means for altering the response of fabric, such as a swag in a drape, or a tablecloth, and to attach items such as decorative renditions of skirts and flowers to a tablecloth.

The prior art listed below did not disclose any patents that possess the novelty of the instant invention, however the following U.S. patents are considered related:

| U.S. Pat. No. | Inventor | Issue Date |
|---|---|---|
| 5,275,225 | Marasco et al. | Jan. 4, 1994 |
| 5,287,614 | Ehrlich | Feb. 22, 1994 |
| 5,996,190 | Peterson | Dec. 7, 1999 |
| 6,477,751 | Baumdicker et al. | Nov. 12, 2002 |
| 6,705,380 | Scolletta | Mar. 16, 2004 |

Marasco et al. in U.S. Pat. No. 5,275,225 discloses a swag support consisting of a rod with a longitudinal slot at the rear. A head portion is mounted in the slot, with an arm extending upward and a C-shaped front extending over the top of the rod, thereby allowing a fabric swag scarf to be introduced from below the rod.

U.S. Pat. No. 5,287,614 issued to Ehrlich discloses a method for attaching a decorative skirt around a tablecloth using spring clips with VELCRO patches. The spring clips are spaced apart and are engaged to extend radially from the tablecloth, as allowed by the flexibility of the cloth, such that the patches face outward and are attached to a mating VELCRO strip on the decorative skirt.

Peterson in U.S. Pat. No. 5,996,190 discloses a retainer to attach a cover and a skirt to a table. C-clamps hold the cover in place and provide a connection for a supporting pin and loop. The pin supports the skirt and the loop accepts wire or string to bind a floral arrangement.

Baumdicker et al. in U.S. Pat. No. 6,477,751 discloses a swag tether clip with a base for gathering a tablecloth. The base has an arm that pivots with male and female members. The method of using the clip includes the steps of fastening the clip to a tablecloth, gathering the cloth, engaging the clip, inserting the male member into the female member.

U.S. Pat. No. 6,705,380 issued to Scolletta discloses a fabric retainer having a decorative body with movable appendages extending therefrom. A portion of at least one of the appendages extends from and is connected to the body such that a passage is formed in which a fabric may be positioned. The decorative body may represent animate or inanimate objects or characters.

For background purposes and as indicative of the art to which the invention is related reference may be made to the remaining cited patents issued to Fogelman in U.S. Pat. No, 4,947,526 and Lightfoot in U.S. Pat. No. 5,544,393.

DISCLOSURE OF THE INVENTION

In the past, tablecloths have been swagged by hand by simply gathering the tablecloth's material and pinning it together with straight or safety pins to create a decorative effect. There has also been a need to easily mount theme decorations on cloth to create a pleasing appearance for festive or special occasions. Therefore, the primary object of the invention is to provide a method of attaching a clip to a fabric without penetrating or damaging the fabric.

The invention is easily used by attaching the two parts of a garter grip together, one on each side of a tablecloth or other fabric, and looping a pair of straps around a gather to make a swag in the material. The two ends of the straps are attached together with hooks and loops of VELCRO fasteners. The use of the invention is not labor intensive, as is the conventional method of using pins, since the invention contains all of the necessary components to form a swag in a tablecloth quickly and easily, with the swag formed in as little as 20 seconds.

An important object of the invention is that the clip serves a dual purpose by permitting a tablecloth to not only be gathered into a swag quickly but also to provide a convenient mount for decorative items on a fabric such as curtains, drapes and the like.

Another object of the invention is the prevention of minor injury to the user when gathering and attaching the swagged material. Such injury to the user is caused due to the difficulty of using pins that are required to penetrate several thicknesses of fabric, which often causes the pins to painfully the user's fingers.

Still another object permits the invention to be reused indefinitely on the same or a different fabric. When using the invention, the fabric is not damaged in any way since it is simply stretched over the button of the garter grip which does not damage or tear the threads. This damage can occur when using metal pins that bear the weight of the gathered fabric directly within the small cross-sectional area of the pin.

Yet another object of the invention permits the garter grip to be connected without looking, as it is intuitively obvious how the inventive fastener works. It is also easy to feel where the button is located through the fabric from the rear, and the wide radial shape of the wireform is also easily located by feel.

A further object of the invention permits hanging decorative items on the front of the clip to cover or disguise the clip. The third embodiment of the invention may be constructed without VELCRO but instead constructed of a decorative material that allows the clip to be exposed in an attractive manner.

A final object of the invention is that it is inexpensive to produce, since the garter grip and VELCRO tape are both made in quantity, the economies of number make the clip economical and within the reach of all.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 20 is a partial isometric view of the third embodiment without a theme decoration.

FIG. 21 is a side view of the third embodiment without a theme decoration.

FIG. 22 is a side view of the third embodiment with a theme decoration attached.

FIG. 23 is a partial isometric view of the rear of the garter grip button end attached to a loop tape strap in the third embodiment.

FIG. 24 is a partial isometric view of the front of the garter grip button end attached to a loop tape strap in the third embodiment.

FIG. 25 is a partial isometric view of the third embodiment with a decorative tape strap.

FIG. 26 is a rear view of a theme decoration representing a flower illustrating the hook tape attached thereunto.

FIG. 27 is a cross-sectional view taken along lines 27-27 of FIG. 26 with the hook tap attached.

FIG. 28 is a cross-sectional view taken along lines 28-28 of FIG. 26 with a magnet attached.

BEST MODE FOR CARRYING OUT THE INVENTION

The best mode for carrying out the invention is presented in terms of a preferred, second, third and fourth embodiment for a fabric attaching clip 10, (hereinafter "FAC 10"). Each embodiment differs only in the method used to attach the invention to a tablecloth or the like. The preferred embodiment of the FAC 10, as shown in FIGS. 1-12, and 26-28, utilizes a garter grip as its basic element. The garter grip is made in two parts: a button end 20 which consists of a flat thermoplastic tab in which a round button is integrally formed, and a wireform 22 which is configured to fit over the button end 20. The wireform 22 has a wide radial shape with a distal end looped in the substantially same diameter as the stem of the button. The garter grip permits the wireform 22 to be placed over the button end 20 with fabric in between. When the wireform 22 is pulled downward the distal end loop engages the stem of the button with the fabric stretched in between, thus forming a secure connection without penetrating the fabric.

In all of the embodiments hook and loop tape is utilized, which is best known by its trademark name VELCRO and consists of two mating tapes, one with hooks and the other with a loop pile. When pressed together, the hook and loop tape forms a secure closure that opens by peeling the two tapes apart. Hook and loop tape is well known in the art is in common usage throughout the world.

Figure 9:
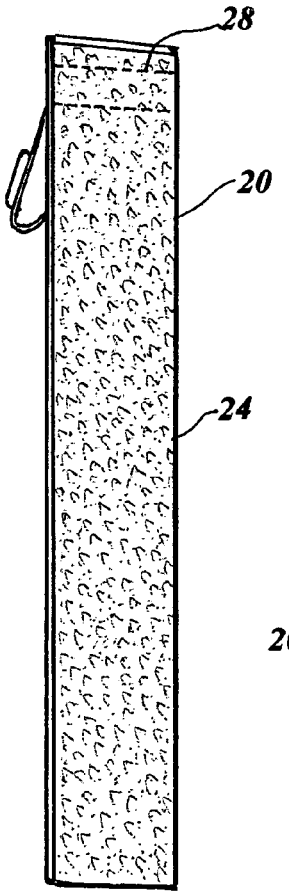
FIG. 9 is a partial isometric view of the rear of the garter grip button end attached to a loop tape strap in the preferred embodiment.
Figure 10:
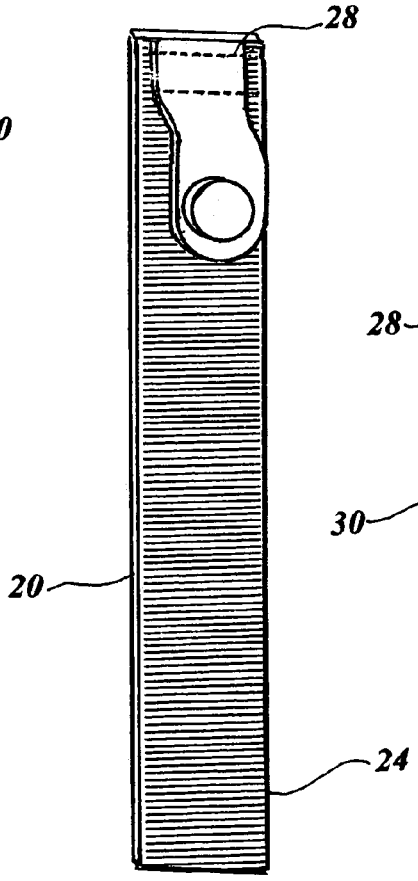
FIG. 10 is a partial isometric view of the front of the garter grip button end attached to a loop tape strap in the preferred embodiment.

The preferred embodiment of the FAC 10 utilizes the garter grip in conjunction with the hook and loop tape, with the garter grip button end 20 attached to a loop tape strap 24 which is positioned on an outer surface of a fabric 26. The assembly of the garter grip button end 20 and loop tape strap 24 is completed using stitching 28 to sew the tab of the button end 20 to the loop tape strap 24 on one end, as shown in FIGS. 9 and 10.

Figure 6:
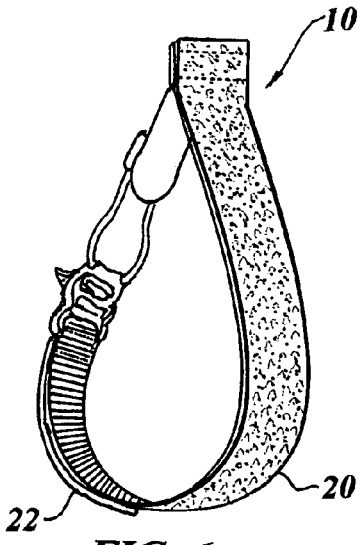
FIG. 6 is a partial isometric view of the preferred embodiment without a theme decoration.
Figure 7:
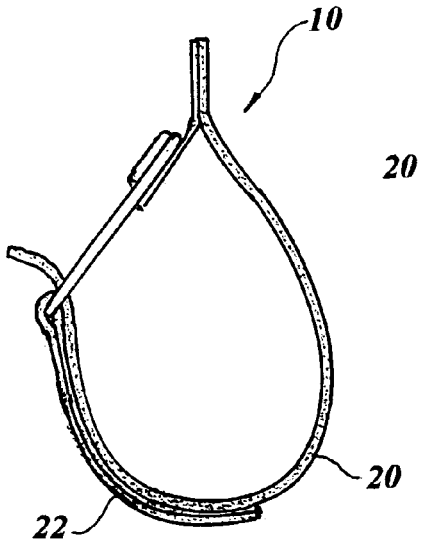
FIG. 7 is a side view of the preferred embodiment without a theme decoration.
Figure 8:
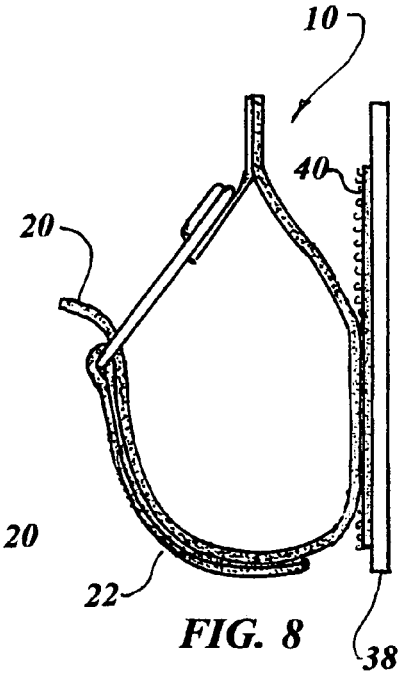
FIG. 8 is a side view of the preferred embodiment with a theme decoration attached.
Figure 11:
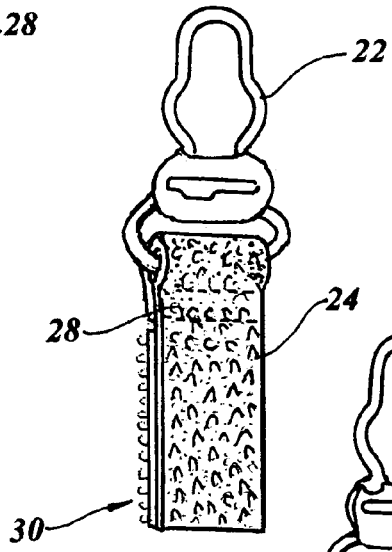
FIG. 11 is a partial isometric view of the front of the garter grip wireform attached to a hook and loop tape strap in the preferred embodiment.
Figure 12:
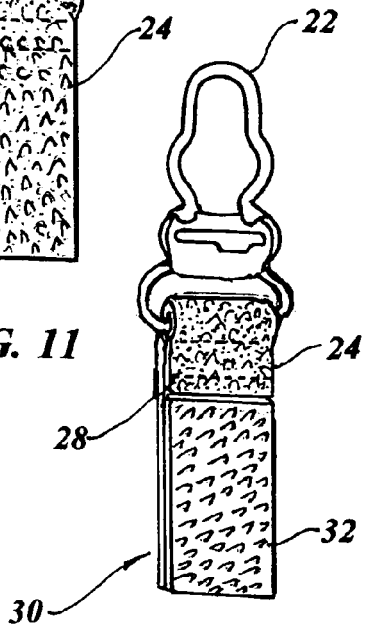
FIG. 12 is a partial isometric view of the rear of the garter grip wireform attached to a hook and loop tape strap in the preferred embodiment.

The garter grip wireform 22 is attached to a hook and loop tape strap 30, as shown in FIGS. 11 and 12. The hook and loop tape strap 30 is positioned on an inner surface of the fabric 26 over the garter grip button end 20, which is then tightly engaged with the fabric 26 drawn compressably between with the grip button end 20 and the wireform 22. The FAC 10 swags the fabric 26 by gathering the fabric 26 together and encompassing the gathers with the hook and loop tape strap 30. The end of the strap 30 is threaded into the wireform 22 and pulled therethrough for adjustment. The loop tape strap 24 is then joined to the hook side 32 of the hook and loop tape strap 30 for closure and retention of the gathered swag. FIGS. 6 and 7 show the fabric attaching clip 10 looped together without the cloth fabric 26, however it is easy to visualize where the fabric interfaces with the button and wireform. It should be noted that the hook and loop tape strap 30 is made of a hook tape strap 32 and a loop tape strap 24. The straps 24,32 are attached on their backsides with a plurality of stitches 28, as shown in FIGS. 11 and 12.

Figure 16:
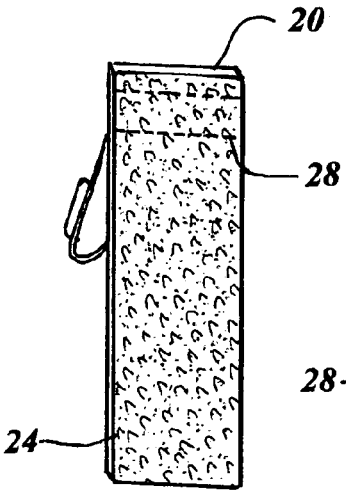
FIG. 16 is a partial isometric view of the rear of the garter grip button end attached to a loop tape strap in the second embodiment.
Figure 17:
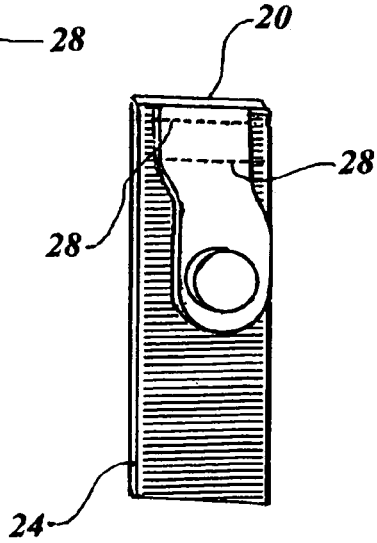
FIG. 17 is a partial isometric view of the front of the garter grip button end attached to a loop tape strap in the second embodiment.

The second embodiment of the FAC 10, is shown in FIGS. 13-19 and, like the preferred embodiment, utilizes the garter grip in conjunction with the hook and loop tape, with the garter grip button end 20 attached to a loop tape strap 24 which is positioned on an outer surface of a fabric 26. The assembly of the garter grip button end 20 and loop tape strap 24 is accomplished using stitching 28 to sew the tab of the button end 20 to the loop tape strap 20 on one end, as shown in FIGS. 16 and 17.

Figure 13:
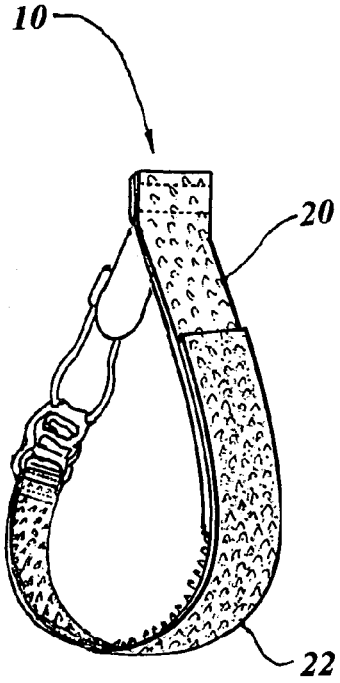
FIG. 13 is a partial isometric view of the second embodiment without a theme decoration.
Figure 14:
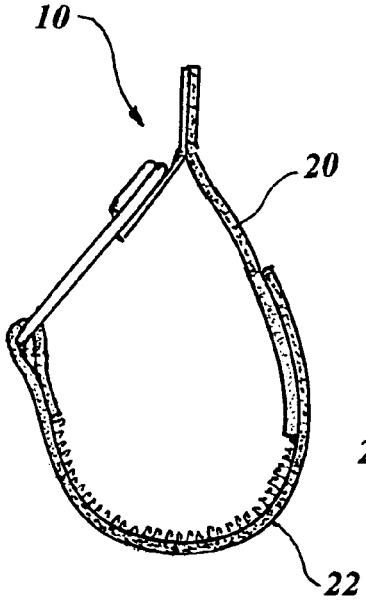
FIG. 14 is a side view of the second embodiment without a theme decoration.
Figure 15:
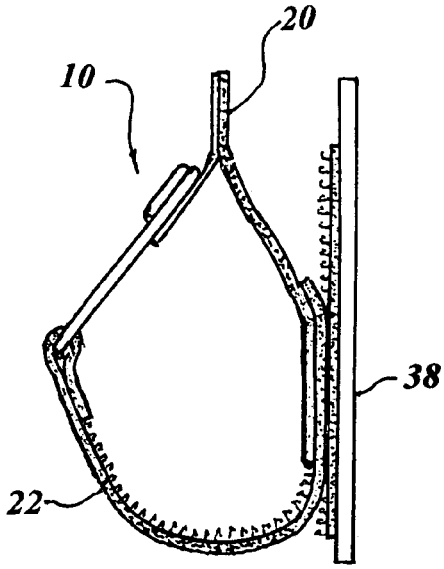
FIG. 15 is a side view of the second embodiment with a theme decoration attached.
Figure 18:
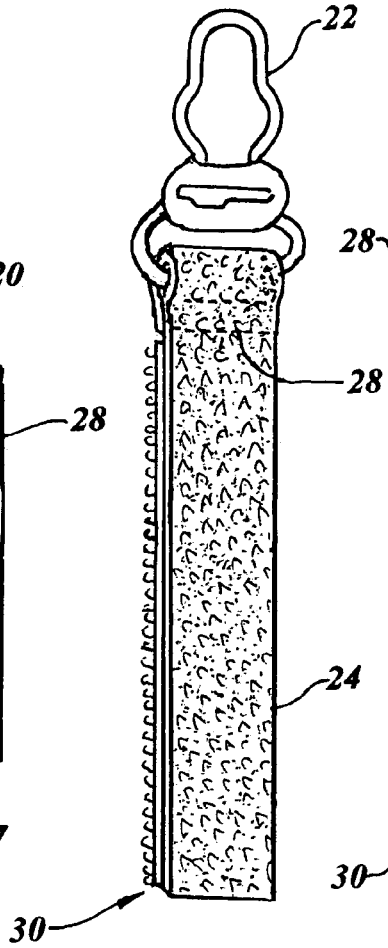
FIG. 18 is a partial isometric view of the front of the garter grip wireform attached to a hook and loop tape strap in the second embodiment.
Figure 19:
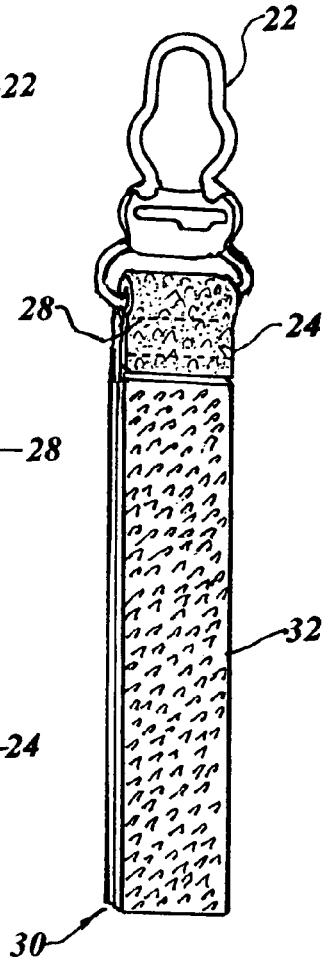
FIG. 19 is a partial isometric view of the rear of the garter grip wireform attached to a hook and loop tape strap in the second embodiment.

The garter grip wireform 22 is attached to a hook and loop tape strap 30, as shown in FIGS. 18 and 19. The hook and loop tape strap 30 is positioned on an inner surface of the fabric 26 over the garter grip button end 20 which is then tightly engaged with the fabric 26 drawn between with the grip button end 20, and wireform 22. The FAC 10 swags the fabric 26 by gathering the fabric 26 together and encompassing the gathers with the loop tape strap 30. The loop tape strap 24 is joined to the hook side 32 of the hook and loop tape strap 30 for closure and retention of the gathered swag. FIGS. 13 and 14 show the fabric attaching clip 10 looped together without the cloth fabric 26.

As with the preferred embodiment, the hook and loop tape strap 30 is made of a hook tape strap 32 and a loop tape strap 24, which are attached on their backsides with a plurality of stitches 28, as shown in FIGS. 18 and 19. However, in the second embodiment the hook and loop tape strap 30 may utilize commercial so-called "back-to-back" hook and loop tape, with the hooks on one side of the tape and loops on the other side.

The third embodiment of the FAC 10, as shown in FIGS. 20-24, employs the same garter grip button end 20 positioned on an outer surface of a fabric 26, with a garter grip wireform 22 positioned on the fabric's 26 inner surface. The garter grip wireform 22 is positioned over the garter grip button end 20 and drawn tightly, thereby engaging the fabric as in the previously discussed embodiments. Means for attaching an article on the outer surface of the fabric 26 adjacent to the garter grip button end 20 is achieved utilizing a single loop tape strap 24 that is located between the garter grip button end 20 and the garter grip wireform 22. Fabric 26 is swagged in this embodiment by manually gathering the fabric 26 together and encompassing the fabric 26 with the loop tape strap 24.

In the above third embodiment, a decorative tape strap 34 may be substituted for the loop tape strap 24 that is located between the garter grip button end 20 and the garter grip wireform 22, which is used for swagging fabric by gathering the fabric 26 together and encompassing the fabric 26 with the decorative tape strap 34. The decorative tape strap 34, as shown in FIG. 25, may have decoration in any form and color that blends well with a tablecloth 36 to create a pealing appearance.

All of the embodiments of the FAC 10, with the exception of the decorative tape strap 34, include means for attaching of an article on the outer surface of the fabric 26 adjacent to the garter grip button end 20, since a portion of the loop tape is exposed. The loop tape strap 24 is uncovered on the front surface of the clip 10 when installed which provides an ideal surface for an article containing VELCRO tape. The invention includes such an article in the form of a theme decoration 38 that includes a hook tape segment 40 attached on the theme decoration's 38 back surface. FIGS. 1-5 and 26-28 show the theme decoration 38, which may be directly attached to the installed attaching clip 10 to provide both a decorative effect for a table and to cover the clip 10. The theme decoration 38 may be made of any hard or soft material and in any shape, color or configuration. The decorations shown in the figures are only representative of a few examples.

While the connection of the theme decoration 38 is shown with a hook tape segment 40 in FIGS. 8, 15, 22, 26 and 27, the means for attaching an article may include a variety of alternates including: a ferrous metal plate 42 that is affixed onto the loop tape strap 24, and theme decoration 38 having a magnet 44 on its rear surface, as shown in FIGS. 22 and 28. Other methods of attachment well known in the art, can also be utilized.

Figure 1:
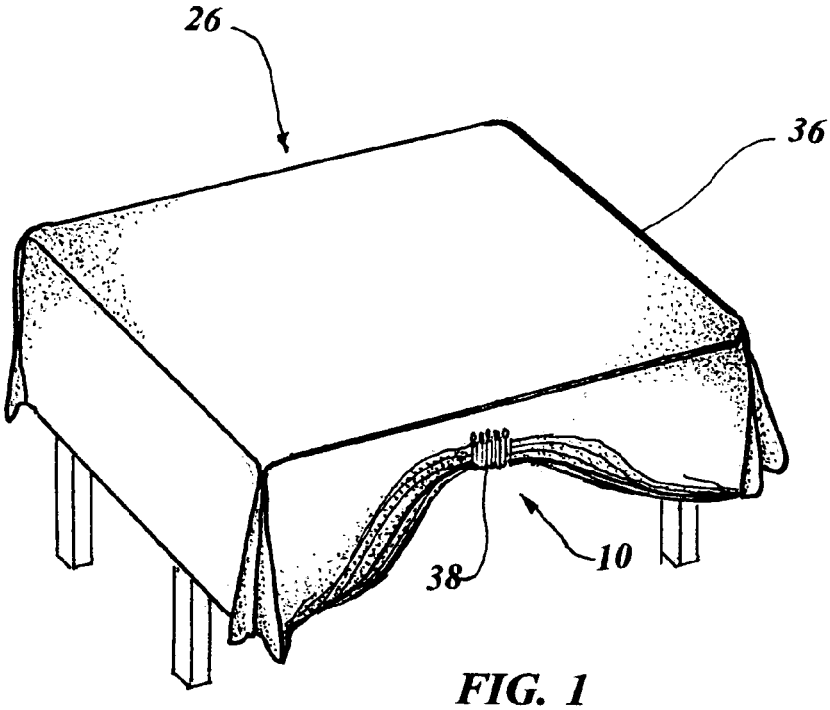
FIG. 1 is a partial isometric view of the preferred embodiment of the clip attached to a tablecloth with the fabric swagged in the middle of one side, and with a theme decoration in the form of birthday candles attached to the clip.
Figure 2:
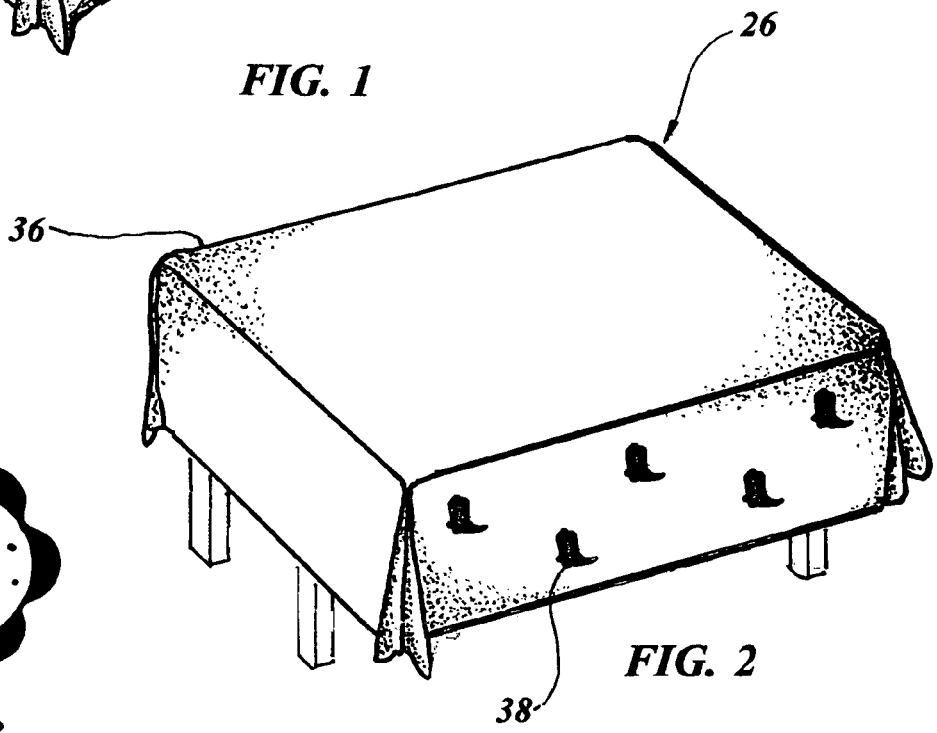
FIG. 2 is a partial isometric view of the preferred embodiment of a number of attaching clips connected to a tablecloth with a theme decoration in the form of boots attached to each clip.
Figure 3:
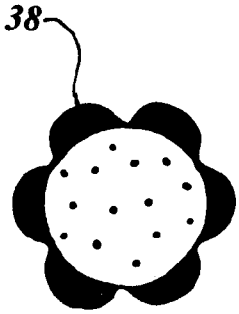
FIG. 3 is a front view of a theme decoration representing a flower.
Figure 4:
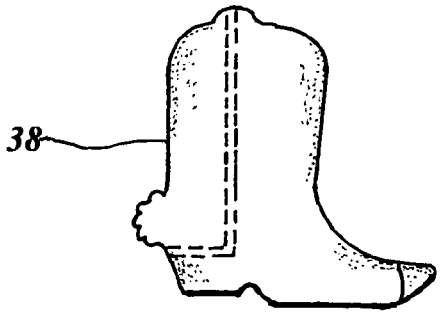
FIG. 4 is a front view of a theme decoration in the form of a cowboy boot.
Figure 5:
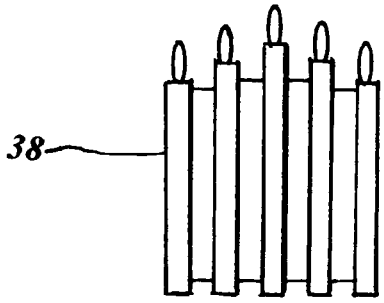
FIG. 5 is a front view of a theme decoration representing birthday candles.
Figure 29:
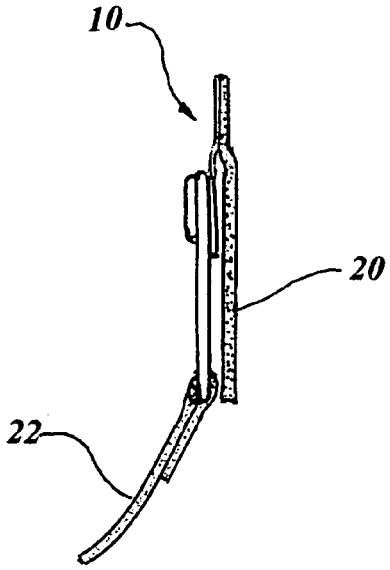
FIG. 29 is a side view of the fourth embodiment with loop tape and a theme decoration attached with hook tape.
Figure 30:
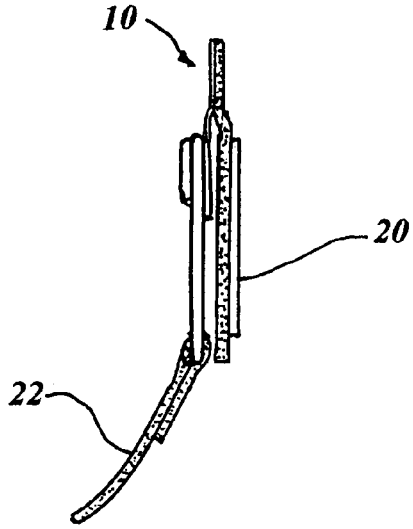
FIG. 30 is a side view of the fourth embodiment with a metal plate and a theme decoration attached with a magnet.
Figure 31:
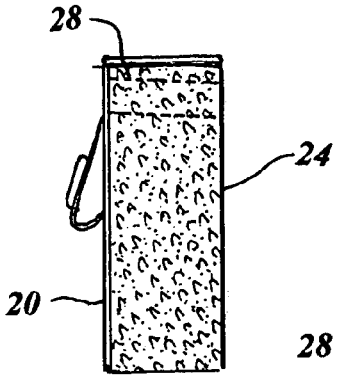
FIG. 31 is a partial isometric view of the rear of the garter grip button end attached to a loop tape strap in the fourth embodiment.
Figure 32:
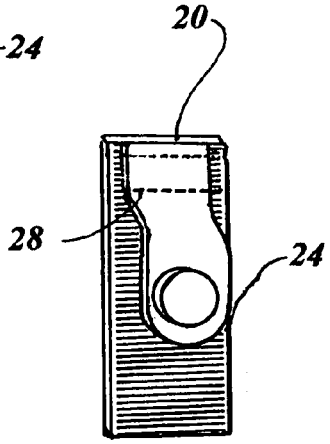
FIG. 32 is a partial isometric view of the front of the garter grip button end attached to a loop tape strap in the fourth embodiment.
Figure 33:
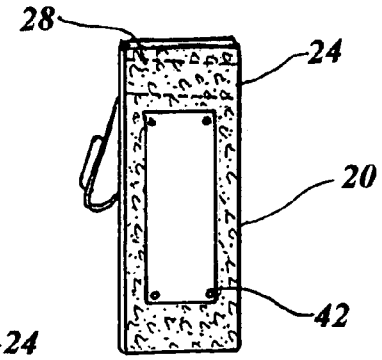
FIG. 33 is a partial isometric view of the rear of the garter grip button end attached to a strap having an integral metal plate in the fourth embodiment.
Figure 34:
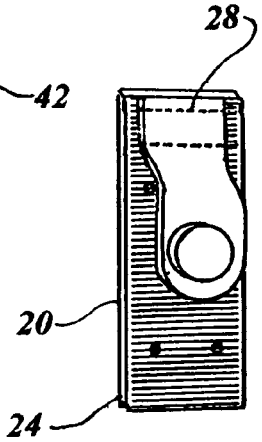
FIG. 34 is a partial isometric view of the front of the garter grip button end attached to a strap having an integral metal plate in the fourth embodiment.
Figure 35:
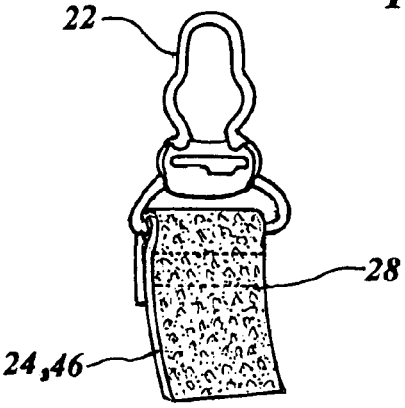
FIG. 35 is a partial isometric view of the rear of the garter grip wireform attached to a strap in the fourth embodiment.
Figure 36:
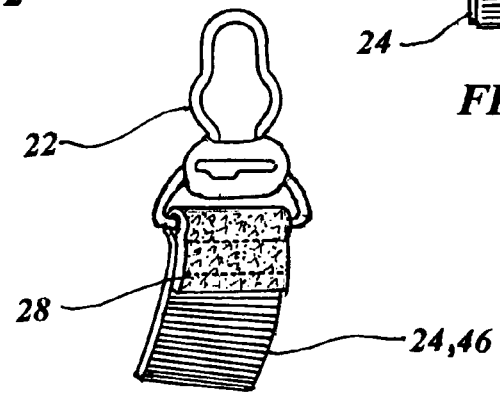
FIG. 36 is a partial isometric view of the front of the garter grip wireform attached to a strap in the fourth embodiment.

The fourth embodiment of the FAC 10, as shown in FIGS. 2, 29-36, includes the same basic elements as described above, however the fourth embodiment's utility is limited to mounting articles on the outer surface of a fabric such as a tablecloth or drape, as shown in FIG. 2, which, as with the above embodiments avoids penetrating the fabric. FIG. 29 shows the clip 10 in side elevation with the theme decoration 38 attached with VELCRO, and FIG. 30 shows the same view, however the mounting is accomplished with the ferrous metal plate 42 that is affixed onto the loop tape strap 24, and the theme decoration 38 has a magnet 44 attached to the rear of the theme decoration. FIGS. 31 and 32 show the garter grip button end 20 and the loop tape strap 24, and FIG. 33 and 34 show the metal plate 42 in place of the VELCRO. FIGS. 35 and 36 show the garter grip wireform 22 with a short section of loop tape strap 24 attached thereunto with stitching 28, however ordinary webbing 46 may be used with equal ease. While the webbing 46 is not shown separately, the material is well known in the art and readily available. Further, the webbing 46 has the same visual appearance as the rear of the loop tape strap 24 shown in FIG. 36. The reason that webbing 46 may be used is that the purpose of the strap 24 or webbing 46 is to provide a gripping tab to pull the wireform 22 over the button 20 of the garter grip.

During use, all of the embodiments are installed onto the fabric 26 in the same manner, with an installer's thumb of one hand placed over the garter grip button end 20 on the outer surface of the fabric 26. The installer's other hand grips the garter grip wireform 22 and places its wide radial-shaped portion over the stem of the button 20 with fabric in between. When the wireform 22 is pulled downward the distal loop end of the wireform 22 engages the stem of the button with the fabric stretched in between, thereby forming a secure connection without penetrating the fabric.

In the preferred embodiment of the FAC 10, when making a swag, the material is gathered and the loop tape strap 24, having the grip button attached, is circled around the gather. The end of the strap 24 is threaded into the open space between the wireform 22 and the attached hook and loop tape strap 30 and pulled by hand to adjust the size of the gather. Once the desired adjustment has been achieved, the hook side of the hook and loop tape strap 30 is urged against the loops of the strap 24, thereby maintaining the attachment.

The second embodiment of the FAC 10, utilizes basically the same procedure for making a swag in the fabric 26, except the loop tape strap 24 is on the garter grip wireform 22 and is circled around the gathered fabric and attached to the hook tape strap 32 that is connected to the garter grip button end 20. Adjustment of the second embodiment is accomplished by the placement of the hooks on the loops of the tapes 32 and 24.

The third embodiment of the FAC 10 attaches the garter grip wireform 22 to the button end 20, as described above, which consequently loops the webbing 46 or loop tape strap 24 around the manually gathered fabric 26, with no further attachment required.

The fourth embodiment of the FAC 10 is for attaching an article to a fabric. Therefore, the garter grip button end 20 has the loop tape strap 24 hanging on the outside when the garter grip 20 is attached to the fabric 26, thus providing the means for attaching an article such as the theme decoration 38 described above.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A fabric attaching clip which comprises:

a) a garter grip button end that is positioned on an outer surface of a fabric, b) a garter grip wireform that is positioned on an inner surface of the fabric, with the garter grip wireform positioned over the garter grip button end and tightly engaged thereupon with the fabric drawn compressably between, and c) means for attaching an article on the outer surface of the fabric adjacent to the garter grip button end, while avoiding penetration through the fabric, wherein said means is selected from the group consisting of:

(1) a loop tape strap for attaching a theme decoration having hook tape affixed thereto, (2) a ferrous metal plate that is integral with said attaching clip for attaching a theme decoration having a magnet affixed thereto, (3) an outer hook and loop tape strap that is connected to said garter grip button end, and an inner hook and loop tape strap that is connected to said garter grip wireform for swagging fabric by gathering the fabric together and encompassing the fabric by joining the inner hook and loop tape strap and the outer hook and loop tape strap together, (4) a loop tape strap that is located between said garter grip button end and said garter grip wireform for swagging fabric by gathering the fabric together and encompassing the fabric with the loop tape strap, and (5) a decorative tape strap that is located between said garter grip button end and said garter grip wireform for swagging fabric by gathering the fabric together and encompassing the fabric with decorative tape strap.

2. A fabric attaching clip which comprises:

a) a garter grip button end attached to a loop tape strap that is positioned on an outer surface of a fabric, and b) a garter grip wireform attached to a hook and loop tape strap that is positioned on an inner surface of the fabric over the garter grip button end and tightly engaged thereupon with the fabric drawn compressably between, wherein said fabric attaching clip swags the fabric by gathering the fabric together and encompassing with the loop tape strap end threaded into the wireform and pulled therethrough for adjustment and the loop tape strap joined to a hook side of the hook and loop tape strap for closure.

3. The fabric attaching clip as recited in claim 2 further comprising a theme decoration having hook tape attached on a rear surface thereof.

4. The fabric attaching clip as recited in claim 3 wherein said loop tape strap provides attachment to the hook tape of the theme decoration.

5. The fabric attaching clip as recited in claim 3 wherein said garter grip button loop tape strap further comprises a ferrous metal plate that is affixed thereon for attaching the theme decoration having a magnet on a rear surface.

6. The fabric attaching clip as recited in claim 2 wherein said garter grip wireform hook and loop tape strap further comprise a loop tape strap circled around the garter grip wireform and attached with stitching, and also hook tape attached to a backside of said loop tape strap, thereby forming the hook and loop tape.

7. The fabric attaching clip as recited in claim 6 wherein said hook and loop tape strap further comprises a hook tape strap and a loop tape strap attached on their backsides with a plurality of stitches.

8. A fabric attaching clip which comprises:

a) a garter grip button end attached to a loop tape strap that is positioned on an outer surface of a fabric, and b) a garter grip wireform to a hook and loop tape strap that is positioned on an inner surface of the fabric over the garter grip button end and tightly engaged thereupon with the fabric drawn compressably between, wherein said fabric attaching clip swags the fabric by gathering the fabric together and encompassing with the hook and loop tape strap which is joined on the hook side of the hook and loop tape, with the loop tape strap for closure.

9. The fabric attaching clip as recited in claim 8 further comprising a theme decoration having hook tape attached on a rear surface thereof.

10. The fabric attaching clip as recited in claim 9 wherein said loop side of the hook and loop tape strap provides attachment to the hook tape of the theme decoration.

11. The fabric attaching clip as recited in claim 9 wherein said garter grip button loop tape strap further comprises a ferrous metal plate that is affixed to the loop tape strap for attaching the theme decoration having a magnet on a rear surface.

12. The fabric attaching clip as recited in claim 8 wherein said garter grip wireform hook and loop tape strap further comprise a loop tape strap circled around the garter grip wireform and attached with stitching, and also hook tape attached to a backside of said loop tape strap forming the hook and loop tape.

13. The fabric attaching clip as recited in claim 12 wherein said hook tape that is attached to the backside of said loop tape strap further comprises a plurality of stitches.

14. The fabric attaching clip as recited in claim 8 wherein said garter grip wireform hook and loop tape strap further comprises a double-sided hook and loop tape, with the hooks on a first side of the tape and loops on a second side, with the double-sided hook and loop tape circling the garter grip wireform and attached with stitching.

* * * * *